US006275121B1

(12) United States Patent
Sasaki et al.

(10) Patent No.: US 6,275,121 B1
(45) Date of Patent: Aug. 14, 2001

(54) MICROWAVE CIRCUIT FOR PHASE SHIFTING HAVING VOLTAGE TRANSFORMING MEANS TO CONTROL SWITCHING

(75) Inventors: Yoshinobu Sasaki; Yasuharu Nakajima; Takaya Maruyama, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/031,554

(22) Filed: Feb. 27, 1998

(30) Foreign Application Priority Data

Sep. 3, 1997 (JP) ..... 9-238159

(51) Int. Cl.[7] ..... H01P 1/18
(52) U.S. Cl. ..... 333/164; 333/139; 333/262
(58) Field of Search ..... 333/164, 139, 333/262, 103; 327/430, 434, 436, 424, 333, 108, 112

(56) References Cited

U.S. PATENT DOCUMENTS

| | | | |
|---|---|---|---|
| 5,107,152 | 4/1992 | Jain et al. | 333/262 X |
| 5,334,959 | 8/1994 | Kafcsik et al. | 333/164 |
| 5,392,010 | 2/1995 | Nakahara | 333/164 X |
| 5,818,283 | 10/1998 | Tonami et al. | 327/436 |
| 5,825,227 | 10/1998 | Kohama et al. | 333/262 X |

FOREIGN PATENT DOCUMENTS

| | | | |
|---|---|---|---|
| 9176927 | 10/1984 | (JP) | 327/430 |
| 99509 | 4/1991 | (JP) | 333/164 |
| 5291805 | 11/1993 | (JP) . | |

*Primary Examiner*—Benny Lee
(74) *Attorney, Agent, or Firm*—Leydig, Voit, & Mayer

(57) ABSTRACT

A microwave phase shifter includes bias regulating circuits generating a gate bias of an FET switch element by processing a control voltage generated by the power-source voltage of an external system and applied to the FET switch element in a transformation process. The off-level of the gate bias is set near the pinch-off voltage. As a result, even when the control voltage of the FET switch element which switches the phase shift amount is restricted due to the circumstance of the system power-source, the off-level of the FET element can be set at a potential near the pinch-off voltage and can suppress delay in the rise of the phase shifter output because the off-level exceeds the pinch-off voltage.

10 Claims, 12 Drawing Sheets

Fig.8 (a)
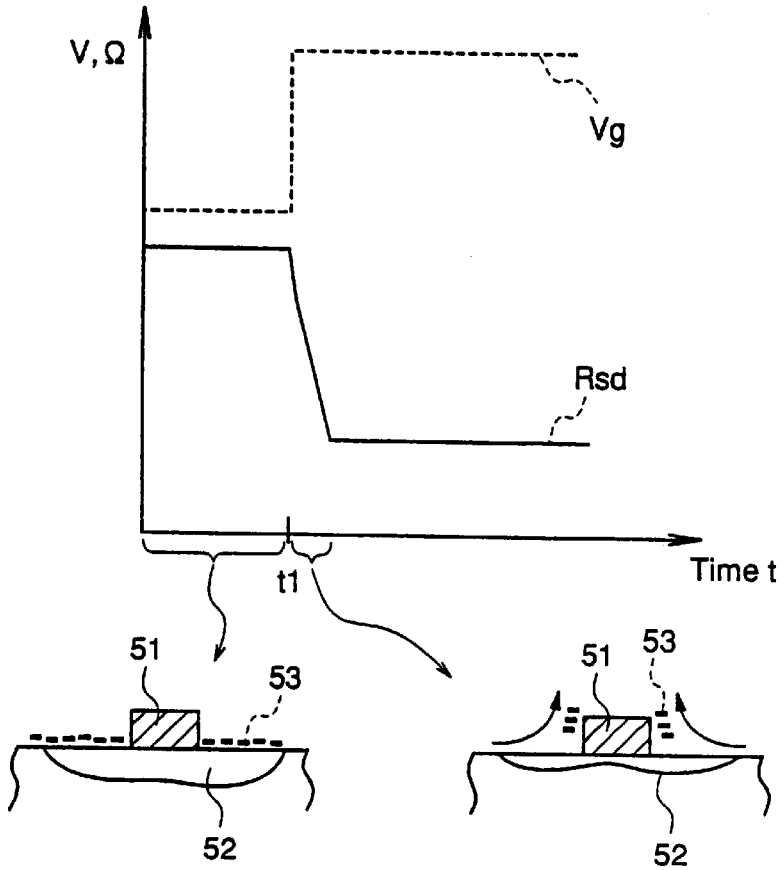
Fig.8 (b) Fig.8 (c)
Fig.9
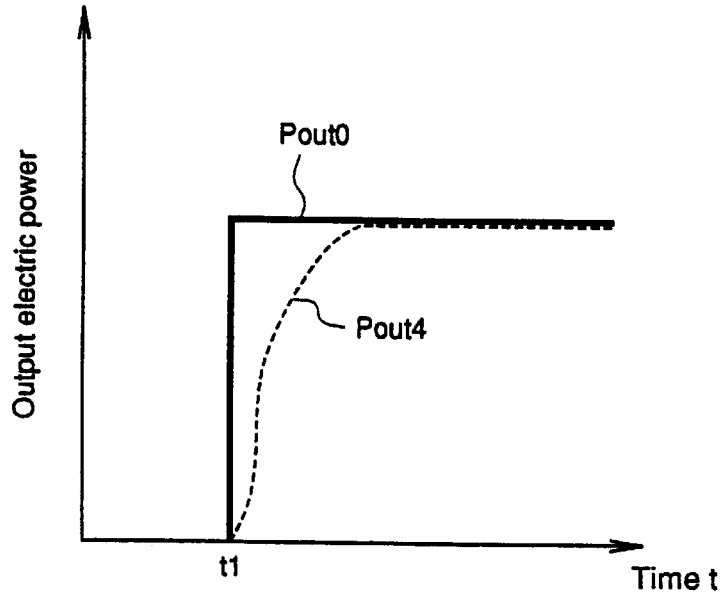

MICROWAVE CIRCUIT FOR PHASE SHIFTING HAVING VOLTAGE TRANSFORMING MEANS TO CONTROL SWITCHING

FIELD OF THE INVENTION

This invention relates to a microwave circuit and, more particularly, to a process for transforming the waveform of a gate bias signal. The gate bias signal controls a field effect transistor (FET) switch in a phase shifter, which shifts the phase of a microwave input signal by on-off action of the FET switch.

BACKGROUND OF THE INVENTION

In the prior art, a phase shifter is employed as one of the component circuits of a phased array antenna and the like. FIG. 13 is a block diagram schematically showing the configuration of a prior art phased array antenna. In the figure, a phased array antenna 200 includes a plurality of antenna elements 211, 212, 213, and 214. The antenna 200 changes the direction D of an incoming or outgoing electromagnetic wave by controlling the phase of the electromagnetic waves in the antenna elements 211, 212, 213, and 214.

The antenna 200 includes amplifiers 221, 222, 223, and 224, all of which amplify microwaves going out from or coming into the corresponding antenna elements 211, 212, 213, and 214, and phase circuits 231, 232, 233, and 234, all of which shift the phases of microwaves going out from or coming into the corresponding antenna elements 211, 212, 213, and 214. The phase circuits 231, 232, 233, and 234 are connected to a signal source 260 and a signal receiver 270 via corresponding directional couplers 251, 252, 253, and 254.

The antenna 200 also includes a control circuit 240 which controls the phase circuits and the directional couplers. More specifically, the control circuit 240 controls the phase shift of the phase circuits 231, 232, 233, and 234 with 5-bit control signals Pc1, Pc2, Pc3, and Pc4, respectively, and switches the connection of each phase circuit to the signal source 260 or to the signal receiver 270 with a control signal Kc.

FIG. 13 shows a phased array antenna which has four antenna elements for simplicity of description. There are more than four antenna elements in an actual phased array antenna.

FIG. 14 shows the specific configuration of the phase circuit having input and output terminals 23*a* and 23*b*, respectively. As shown in FIG. 14, each of the phase circuits 231, 232, 233, and 234 of FIG. 13 comprises five switched-line phase shifters 230*a*, 230*b*, 230*c*, 230*d*, and 230*e*, all of which provide different phase shifts. The phase shift is defined as the difference in phase between signals at the phase shifter output and input.

The first shifter 230*a* comprises first and second transmission lines 13 and 14 which have electrical lengths that differ by $\lambda/32$ ($\lambda$ is the wavelength of a propagating microwave), an input switch 311 which selects between input terminals of the transmission lines 13 and 14, and an output switch 312 which selects between the output terminals of the transmission lines. The second to fifth shifters 230*b*, 230*c*, 230*d*, and 230*e* have almost the same configuration as that of the first shifter 230*a*. However, in the second shifter 230*b*, the difference in electrical length between the first and second transmission lines is $\lambda/16$; in the third shifter 230*c* the difference in electrical length between the first and second transmission lines is $\lambda/8$; in the fourth shifter 230*d* the difference in electrical length between the first and second transmission lines is $\lambda/4$; and in the fifth shifter 230*e* the difference in electrical length between the first and second transmission lines is $\lambda/2$.

Further, the switching actions of each pair of the input and output switches 311 and 312 of each phase shifter are respectively controlled by switch control signals Pca, Pcb, Pcc, Pcd, and Pce as a control signal of each phase circuit. In the phase circuit so constructed, the phase of microwave input can be varied in steps of 11.25° in the range of from 11.25° to 348.75° using a 5-bit control signal.

FIG. 11(*a*) shows a detailed configuration of the above-mentioned switched-line shifter. Note that for the simplicity of description a phase shifter 230 represents the shifters 230*a*, 230*b*, 230*c*, 230*d*, and 230*e* without distinction in FIG. 11(*a*) because the distinction among these shifters is only the phase shift as described with respect to FIG. 14.

The phase shifter 230 includes an input switch 311 (shown in FIG. 14) comprising a first input-side FET element 50*a* connected between a high-frequency frequency input terminal (RF input terminal) 2 and the input terminal of a transmission line 13 and a second input-side FET element 50*c* connected between the RF input terminal 2 and the input terminal of a second transmission line 14. The phase shifter 230 also includes an output switch 312 (shown in FIG. 14) comprising a first output-side FET element 50*b* connected between a high-frequency output terminal(RF output terminal) 3 and the output terminal of the transmission line 13 and a second output-side FET element 50*d* connected between the RF input terminal 3 and the output terminal of the second transmission line 14.

Since all elements constituting the phase shifter 230 are fabricated on a monolithic microwave IC (MMIC) substrate, GaAs MESFETs are employed as the FET switches 50*a*, 50*b*, 50*c*, and 50*d*. The bias voltage applied to the sources and drains of the FET switches 50*a*, 50*b*, 50*c*, and 50*d* is provided by the power-source voltage (5V) because of restrictions on the power-source from the external system (a phased array antenna control circuit). In each of the FET elements fabricated on the substrate there is an effective inductance L between the source and the drain. Therefore, as shown in FIG. 11(*a*), the power-source voltage (5V) is applied via a bias resistance 1 to the source of one of the four FET switches constituting the phase shifter (here the one is the FET switch 50*d*), thereby setting the potential between the source and drain of each FET switch at 5V.

In the prior art phase shifter 230, 5V is applied to the gate terminals 5*a*, 5*b*, 5*c*, and 5*d* of the respective FET switches as the on-potential which places each FET in the on-state, and 0V is applied to the gate terminals 5*a*, 5*b*, 5*c*, and 5*d* of the respective FET switches as the off-potential which places each FET element in the off-state.

In the phased array antenna 200 shown in FIG. 13, a microwave signal generated by the signal source 260 is supplied to the phase circuits 231, 232, 233, and 234 via the directional couplers 251, 252, 253, and 254, respectively. The microwave signal is then subjected to a process that shifts its phase forward or backward by a given amount in each of the phase circuits before being applied to the amplifiers 221, 222, 223, and 224, respectively. Finally, the microwave signals amplified in the amplifiers are radiated from the antenna elements 211, 212, 213, and 214 into the air.

The traveling direction of the microwaves radiated by the antenna 200 is a direction D that is perpendicular to a wavefront W. The wavefront W consists of parts having the same phase in the microwave signals radiated from the antenna elements. In other words, microwaves are radiated from the antenna 200 in the direction D. The radiation direction D depends on the phase shift set by the control signals Pc1, Pc2, Pc3, and Pc4 in the phase circuits 231, 232, 233, and 234.

The only electromagnetic waves coming into the phased array antenna 200 are electromagnetic waves reflected from a target, i.e., from the direction D. The incoming electromagnetic waves are supplied to the amplifiers 221, 222, 223, and 224 via the antennas 211, 212, 213, and 214. The incoming electromagnetic waves are amplified in the amplifiers and then supplied to the receiver 270 via the directional couplers 251, 252, 253, and 254.

As described with respect to FIG. 14, the phase shifters 230*a*, 230*b*, 230*c*, 230*d*, and 230*e*, each of which is an element of the phase circuits 231, 232, 233, and 234, respectively, have a phase shift controlled by the control signals Pc1, Pc2, Pc3, and Pc4 from the control circuit 240. Thereby, the direction D of outgoing and incoming electromagnetic waves from the phased array antenna 200 vary within a given range. Consequently, the phased array antenna 200 can scan using the microwave-sending-and-receiving operation described above.

Next, an explanation is given of the operation of the phase circuit and the phase shifter, a component of the phase circuit.

In the phase circuits 231, 232, 233, and 234, the phase shifts produced by the components, i.e., phase shifters 230*a*, 230*b*, 230*c*, and 230*e*, are controlled by the control circuit 240 shown in FIG. 13. In this case, when an RF signal is input to the input terminal 23*a* of each of the phase circuits 231, 232, 233, and 234, the phase of the RF signal successively changes by a given amount in each phase shifter of each phase circuit. As a result, in each phase circuit, the phase of the RF signal changes by the total of the phase amounts set in the first to fifth phase shifters.

The setting of the phase amount of the phase shifter 230, i.e., the switching of the phase amount, is carried out by the switching of the input-side switch 311 or the output-side switch 312.

As more specifically discussed with respect to FIG. 11(*a*), the RF signal input from the RF input terminal 2 is transmitted through either the first transmission line 13 or the second transmission line 14 of the switched-line phase shifter 230 and is output from the RF output terminal 3. In this case, for example, 5V is applied to the gate terminal 5*a* of the first input-side FET switch 50*a* and the gate terminal 5*b* of the first output-side FET switch 50*b*, while 0V is applied to the gate terminal 5*c* of the second input-side FET switch 50*c* and the gate terminal 5*d* of the second output-side FET switch 50*d*, when the RF signal is transmitted through the first transmission line 13. On the other hand, 0V is applied to the gate terminal 5*a* of the first input-side FET switch 50*a* and the gate terminal 5*b* of the first output-side FET switch 50*b*, while 5V is applied to the gate terminal 5*c* of the second input-side FET switch 50*c* and the gate terminal 5*d* of the second output-side FET switch 50*d*, when the RF signal is transmitted through the first transmission line 14. Accordingly, by switching the voltages applied to the gate terminals 5*a*, 5*c*, 5*b*, and 5*d* of the first and second input-side FET switches and the first and second output-side FET switches, respectively, the phase of the input RF signal can be changed.

As described above, in the prior art phased array antenna 200, the component phase shifters use the power-source voltage of the system (the control circuit of the array antenna) as the control voltage. That is, there are applied the on-potential 5V and the off-potential 0V to the bias terminals of the phase shifters, i.e., the gate terminals 5*a*, 5*b*, 5*c*, and 5*d* of the FET switches of the phase shifter. In this case, the bias voltage (off-potential) which places the FET switches in the off-state is much lower (0V) than the pinch-off potential which cuts off the operating current between the source and the drain. The pinch-off potential is generally 4V which is 1V lower than the voltage applied to the source and the drain. For this reason, at the time of the phase switching of the phase shifter, i.e., the on-off switching of the first and second FET switches of the input-side and output-side switches 311 and 312, respectively, the phase change of the phase shifter output is delayed.

FIG. 12(*a*) shows the phase change of the output of the phase shifter shown in FIG. 11(*a*). In the figure, L13 indicates the phase of the output of the phase shifter when the FET switches 50*a*, 50*b*, 50*c*, and 50*d* are controlled so that the microwave input is transmitted through the first transmission line 13; L14 indicates the phase of the output of the phase shifter when the FET switches 50*a*, 50*b*, 50*c*, and 50*d* are controlled so that the microwave input is transmitted through the second transmission line 14; t1 and t2 indicate the phase-switching times at which the transmission lines are switched in the phase shifter. The line Ph0 shows the ideal phase change of the output of the phase shifter, and the line Ph1 shows the actual phase change. As will be apparent from FIG. 12(*a*), in the real phase shifter, it takes time from the phase-switching time for the output to reach the desired phase.

FIG. 12(*b*) shows the change of the output power of the phase shifter at the phase-switching times. Line Pout0 of FIG. 12(*b*) indicates the ideal change of the output power of the phase shifter from the phase-switching time t1 to t2, and the line Pout1 indicates the actual change. As will be observed from the figure, the rise of the output power has a delay at the phase-switching times of the output of the phase shifter.

As described above, in the prior art phase shifter, the rise of the output power is delayed at the phase-switching times of the output of the phase shifter, partly because of capacitances between the gate and source and between the gate and drain of the component FET switch of the phase shifter.

In addition to the rise time problem in the output of the phase shifter at the phase-switching times, the pinch-off voltages of the FETs are not uniform among different lots or on the same wafer. Therefore, the delays of the phase shifters are not uniform.

FIG. 11(*b*) shows a configuration of the measurement circuit for measuring the change of the output voltage of the phase shifter shown in FIG. 12(*b*). In this measurement circuit, a switch circuit 300*a* is connected to the output terminal 3 of the phase shifter 230, and includes an input node 31 and first and second output nodes 32*a* and 32*b*. In the switch circuit 300*a*, an input node 31 is connected to the output terminal 3, the first output node 32*a* is connected to a measurement terminal 301 and the second output node 32*b* is connected to the ground. The switch circuit 300*a* is controlled by the control signal Pc of the FET switch of the phase shifter 230. Specifically, in the switch circuit 300*a*, the input node 31 is connected to the output node 32*a* when microwaves are transmitted through the second transmission line 14 in the phase shifter, and the input node 31 is connected to the output node 32*b* when microwaves are transmitted through the first transmission line 13 in the phase shifter shown in FIG. 11(*a*). Therefore, at the measurement terminal 301, there appear the microwaves which have been transmitted through the second transmission line 14.

SUMMARY OF THE INVENTION

An object of this invention is to provide a microwave circuit suppressing delay in the rise of the output power upon phase-switching and reducing non-uniformities of the delays in the rise of output power because the pinch-off voltages are not uniform among different lots or on the same wafer.

Other objects and advantages of this invention will become apparent from the detailed description given hereinafter; it should be understood, however, that the detailed description and specific embodiment are given by way of illustration only, since various changes and modifications within the scope of the invention will become apparent to those skilled in the art from this detailed description.

According to a first aspect of this invention, a microwave circuit comprises a plurality of transmission lines having different electrical lengths; a plurality of FET switches connected to the transmission lines and switched on and off by a gate bias; and voltage waveform transforming means for generating the gate bias by processing a control voltage for the FET switch generated by a power-source voltage of an external system wherein the transmission line through which a microwave input signal propagates is selected by on-off control of the FET switch in order for the phase of the microwave input signal to be changed. As a result, even when the control voltage of the FET element which switches the phase is restricted by the system power source, the off-level of the FET (the gate voltage in off-state) is near the pinch-off voltage and suppresses delay in the rise of the phase shifter output that would occur when the off-level is deeper than the pinch-off voltage.

According to a second aspect of this invention, in the microwave circuit of the first aspect, the voltage waveform transforming means includes first and second voltage dividing resistance elements connected in series and generating a gate bias by voltage-dividing the control voltage. The resistances of the voltage dividing resistance elements are set so that when the same constant voltage as the power-source voltage of the external system is applied to the source and drain of the FET switch, the voltage difference between the pinch-off voltage of the switching FET and the off-potential of the gate bias, which places the FET switch in the off-state, is a prescribed value. As a result, the voltage waveform transforming means can simply be resistors.

According to a third aspect of this invention, in the microwave circuit of the first aspect, the voltage waveform transforming means includes a diode bias FET and a bias resistor connected in series and generating the gate bias by voltage-dividing the control voltage with both of the elements. The off-potential of the gate bias, which places the FET switch in the off-state, is set so that the voltage difference between the off-potential and the pinch-off voltage of the switching FET is deeper by a given value than the variations in the pinch-off voltage due to the fabrication process. As a result, even when the pinch-off voltages of the FET switches are non-uniform, the voltage difference between the gate bias of the FET switch and the non-uniform pinch-off voltage is suppressed by the change of the on-resistance of the bias FET. Therefore, the desired state in which the off-bias of the FET switch is deeper by a constant value than the pinch-off voltage is maintained in spite of the non-uniformities. Thereby, the yield of a microwave circuit as the phase shifter is improved.

According to a fourth aspect of the present invention, in the microwave circuit of the second aspect, the voltage waveform transforming means includes an auxiliary circuit consisting of an auxiliary resistor and a capacitance connected in series. The auxiliary circuit is connected in parallel with the first voltage dividing resistor between the connecting point of the first and second voltage dividing resistors connected in series and the terminal to which the control voltage is applied. As a result, even when the voltage difference between the on and off levels of the gate bias is smaller than the control voltage in waveform transformation processing, the gate bias temporarily changes by the amount of the voltage difference of the control voltage, due to the capacitance at the time of switching the gate bias levels. Therefore, the delay in the rise of the gate bias due to the capacitance of the gate of the FET switch is reduced.

According to a fifth aspect of the present invention, in the microwave circuit of the third aspect, the voltage waveform transforming means includes an auxiliary circuit consisting of an inductor and an auxiliary resistor connected in series, which is connected in parallel with the diode bias FET and the bias resistor. When the gate bias output by the voltage waveform transforming means is changed from the off-potential, which places the FET switch in the off-state, to the on-potential, which places the FET switch in the on-state, overshoot of the gate bias occurs. As a result, when the levels of the gate bias are switched, the gate bias rises in a sharp pulse due to the inductor. Therefore, the delay of the change of the resistance between the source and drain of the FET switch for the change of the gate bias is reduced.

According to a sixth aspect of the present invention, in the microwave circuit of the fifth aspect, the voltage waveform transforming means has element constants so that the waveform of the overshoot of the gate bias is suitable for the removal of a surface electric charge of the FET switch caused by the potential change of the overshoot. As a result, the waveform of the output power can be an ideal waveform corresponding to the change of the gate bias of the FET switch.

BRIEF DESCRIPTION OF THE DRAWINGS

FIG. 2(*b*) is a diagram of a specific configuration of a bias regulating circuit of the phase shifter.

FIG. 2(*c*) is a graph showing an operating waveform of the bias regulating circuit.

FIG. 5(*b*) is a diagram showing a variant example of the bias regulating circuit.

FIG. 6(*b*) is a graph showing an output waveform of the phase shifter of the third embodiment of the invention.

FIG. 6(*c*) is a graph indicating the improvement of the delay of the output change of the bias regulating circuit in the phase shifter of the third embodiment of the invention.

FIG. 8(*a*) is a graph showing an operating waveform of an FET switch of the phase shifter of the fourth embodiment of the invention.

FIG. 8(*b*) and FIG. 8(*c*) are diagrams showing the change of a depletion layer of the FET switch of the phase shifter of the fourth embodiment of the invention.

FIG. 9 is a graph showing an output waveform of the bias regulating circuit of the phase shifter of the fourth embodiment of the invention.

FIG. 10(*b*) is a graph showing the change of the resistance between the source and drain of the FET switch of the phase shifter of the fourth embodiment of the invention.

FIG. 11(*b*) is a diagram showing a measurement circuit for the output waveform of a phase shifter.

FIG. 12(*b*) is a graph showing an output power waveform of a prior art phase shifter.

In all figures, like elements are given the same reference numbers.

DETAILED DESCRIPTION OF PREFERRED EMBODIMENTS

[Embodiment 1]

Figure 1:
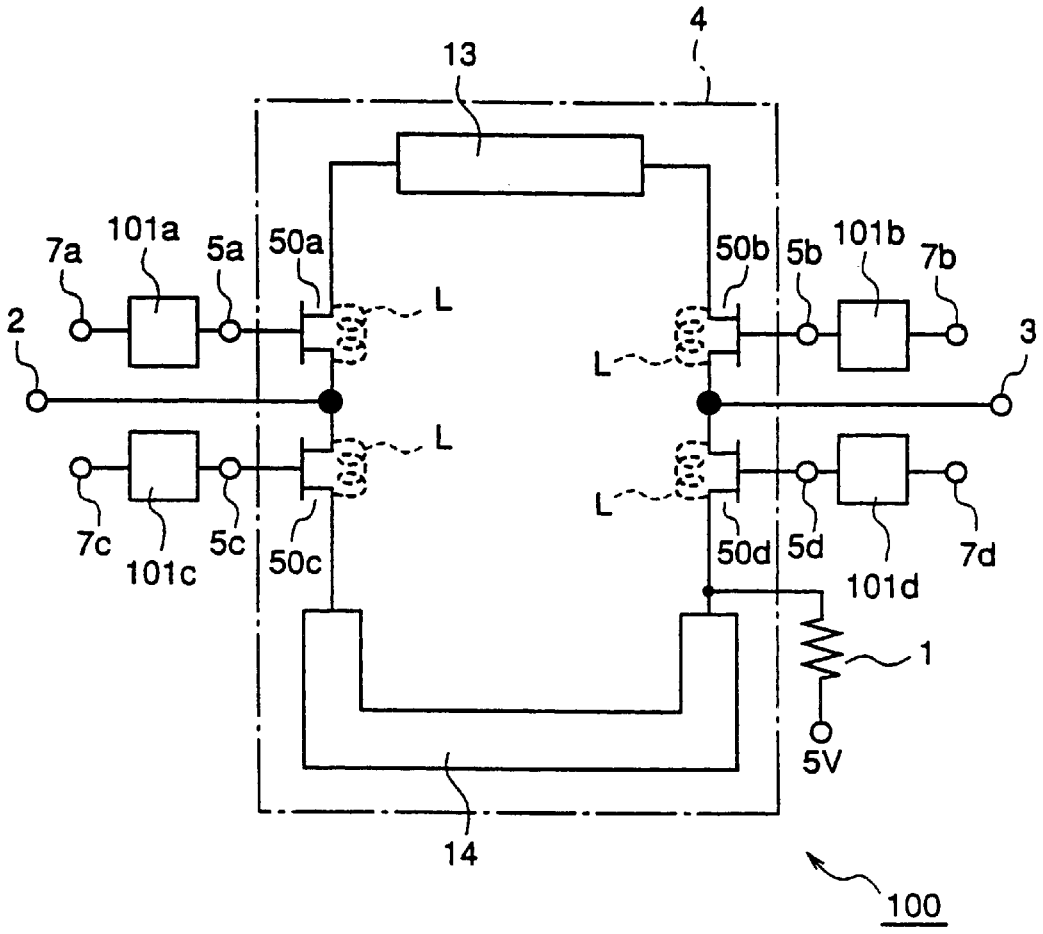
FIG. 1 is a diagram showing a schematic configuration of a microwave circuit as a phase shifter according to a first embodiment of the invention.
Figure 2:
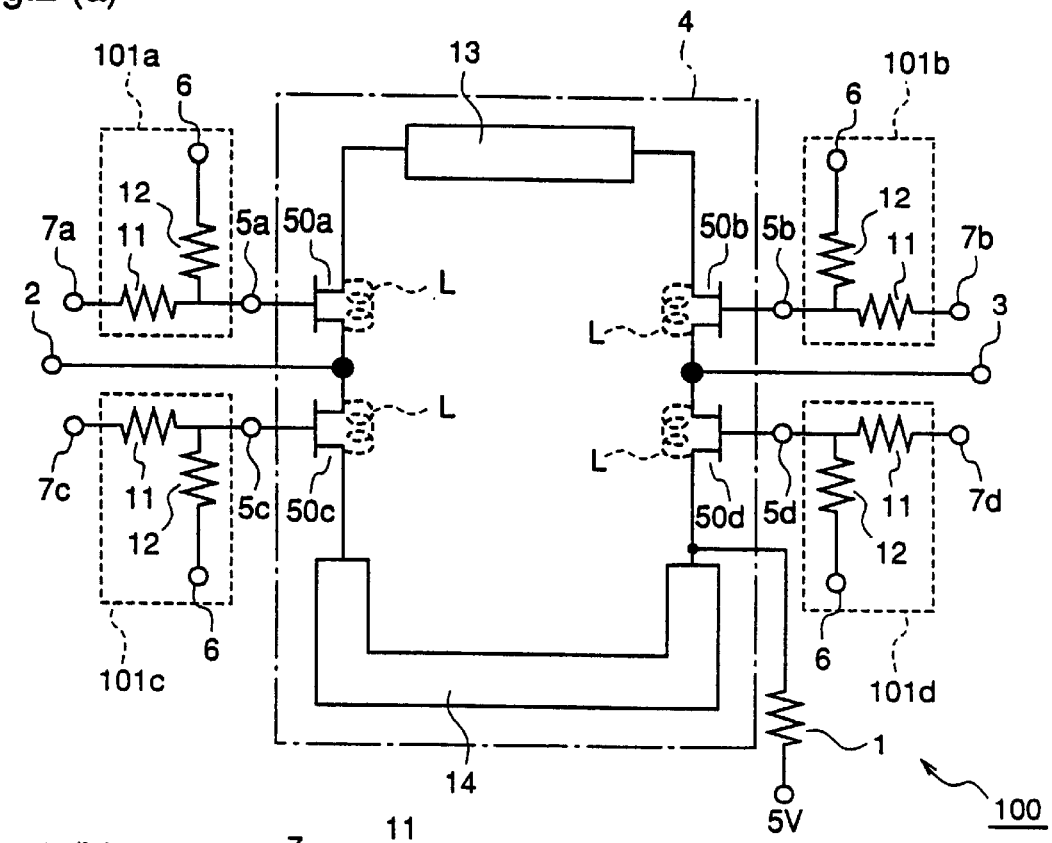
FIG. 2(*a*) is a diagram of a configuration of the phase shifter.
Figure 2:
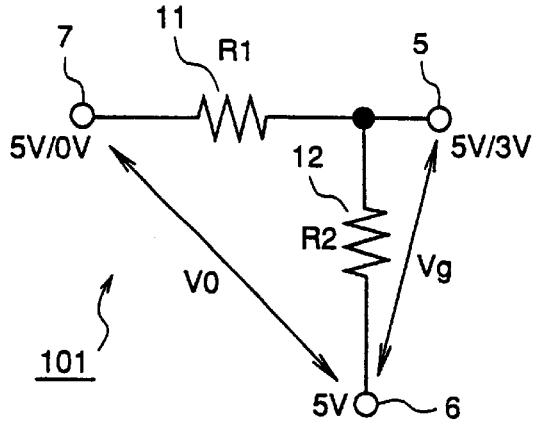
Figure 2:
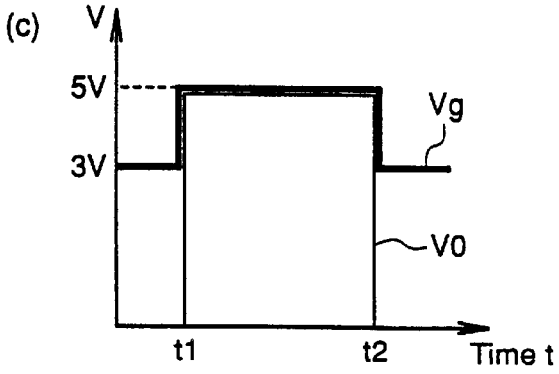

FIGS. 1, 2(*a*), 2(*b*), 2(*c*), and 3 are diagrams for explaining a microwave circuit as a phase shifter according to a first embodiment of the invention. FIG. 1 shows the basic configuration of the phase shifter. FIG. 2(*a*) also shows the configuration of the phase shifter. FIG. 2(*b*) shows the configuration of a bias regulating circuit included in the phase shifter. FIG. 2(*c*) shows the operating waveform of the bias regulating circuit.

In FIGS. 1, 2(*a*), 2(*b*), 2(*c*), and 3, the phase shifter 100 has an input terminal 2 and an output terminal 3. The phase shifter 100, similar to the prior art phase shifter 230, is a component of the phase circuits 231, 232, 233, and 234 in the phased array antenna 200.

The phase shifter 100, similar to the prior art phase shifter 230, includes first and second transmission lines 13 and 14 having different electrical lengths, first and second input-side FET switches 50*a* and 50*c* connected to the input terminals of the first and second transmission lines 13 and 14, respectively, and first and second output-side FET switches 50*b* and 50*d* connected to the output terminals of the first and second transmission lines 13 and 14, respectively. The FET switch 50*d*, at the end of the second transmission line 14, is grounded through a resistor 1. The first and second transmission lines 13 and 14 and the FET switches 50*a*, 50*b*, 50*c*, and 50*d* constitute the main body 4 of the phase shifter which has the same function as that of the prior art phase shifter 230. In the first embodiment, similar to the prior art phase shifter, 5V is applied to the source and drain of each of the FET switches 50*a*, 50*b*, 50*c*, and 50*d*, and each of the FET switches 50*a*, 50*b*, 50*c*, and 50*d* comes into the on-state when the gate bias reaches 5V and into a perfect off-state when the gate bias is 0V. Each of the FET switches includes a source-to-drain inductance L.

Further, the phase shifter 100 includes bias regulating circuits (voltage waveform transforming means) 101*a*, 101*b*, 101*c*, and 101*d* corresponding to the FET switches 50*a*, 50*b*, 50*c*, and 50*d*, respectively. The bias regulating circuits 101*a*, 101*b*, 101*c*, and 101*d* receive, from bias terminals 7*a*, 7*b*, 7*c*, and 7*d*, the control voltages of the FET switches 50*a*, 50*b*, 50*c*, and 50*d* generated by the power-source voltage of the external waveform system (the control circuit of the phased array antenna) and process the control voltages to generate the gate bias of the FET switches.

The bias regulating circuit 101*a* of FIG. 2(*a*) comprises a first voltage dividing resistor 11 connected between the bias terminal 7*a* and the gate terminal 5*a* of the FET switch 50*a*, and a second voltage dividing resistor 12 connected between the gate terminal 5*a* and the power-source terminal 6. The other bias regulating circuits 101*b*, 101*c*, and 101*d* also comprise first and second voltage dividing resistors 11 and 12, similar to the bias regulating circuit 101*a*. One terminal of each of the first voltage dividing resistors 11 is connected to each of the bias terminals 7*b*, 7*c*, and 7*d*. One terminal of each of the second voltage dividing resistors 12 is connected to the power-source terminal 6. The other terminals of each of the first and second voltage dividing resistors 11 and 12 are connected to a respective one of the gate terminals 5*a*, 5*b*, 5*c*, and 5*d* of the FET switches 50*b*, 50*c*, and 50*d*. In this case, 5V is applied to the power-source terminal 6.

Figure 13:
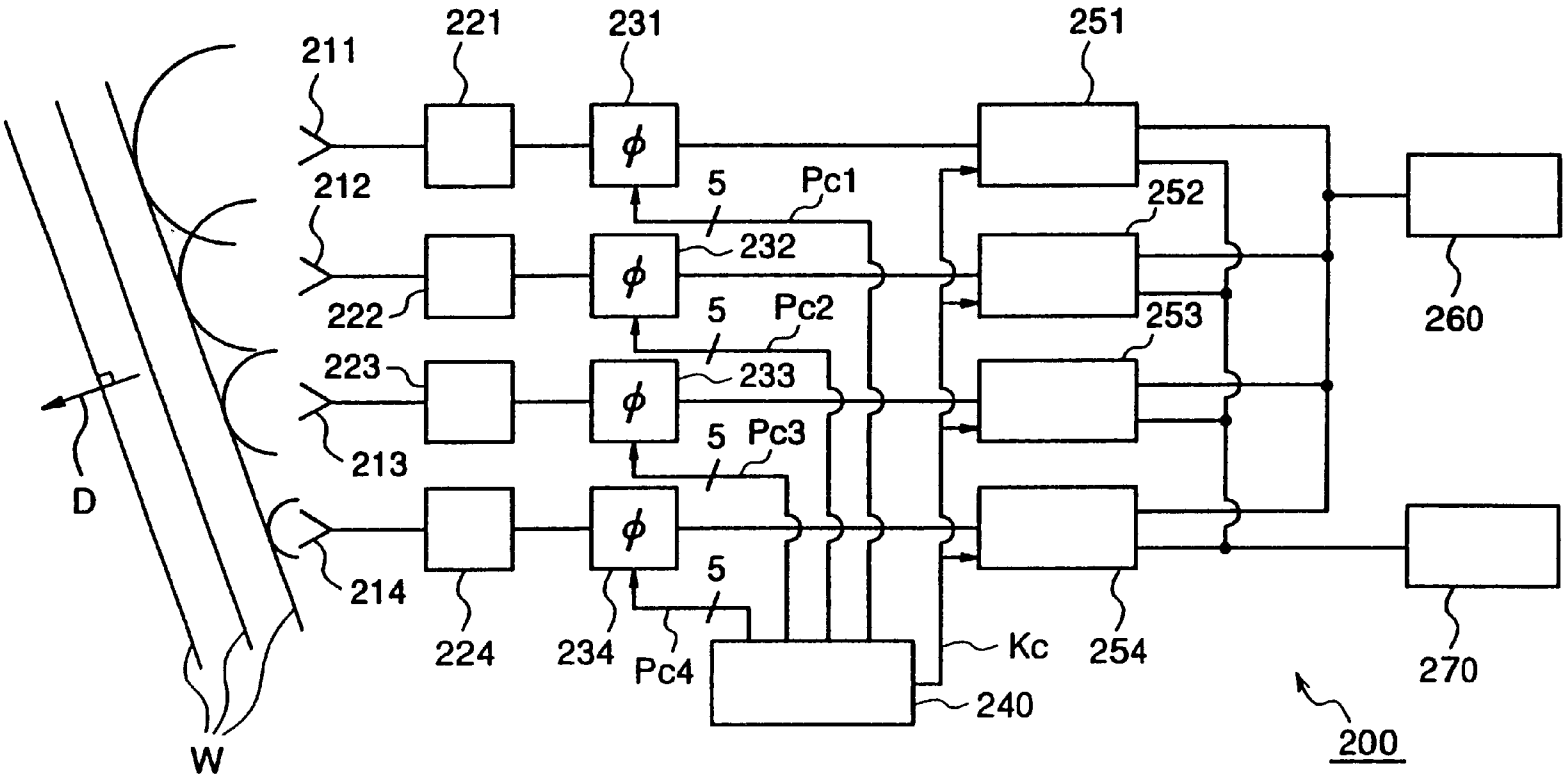
Fig.13 Prior Art
FIG. 13 is a diagram for explaining a prior art phased array antenna.
Figure 14:
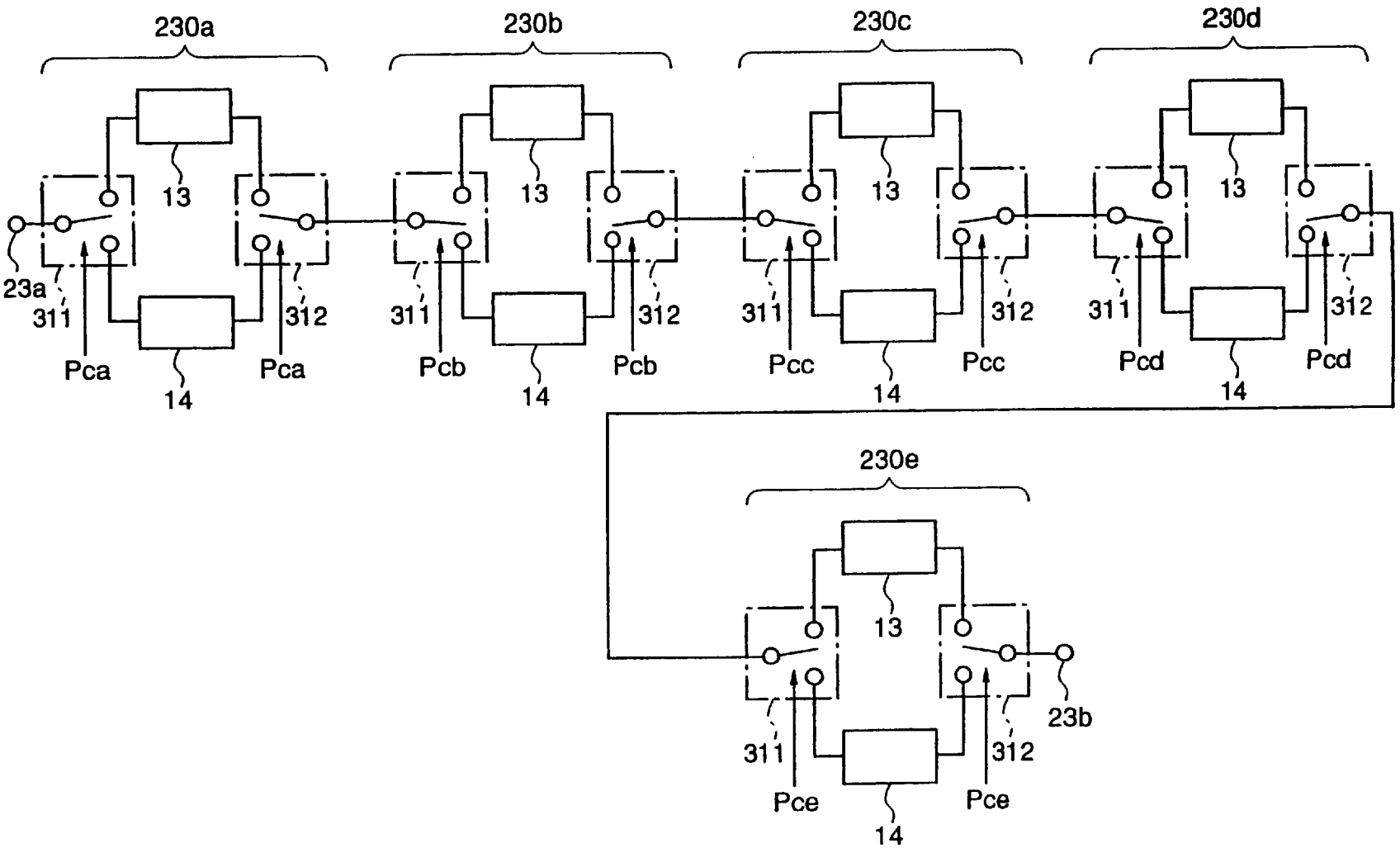
Fig.14 Prior Art
FIG. 14 is a diagram showing a configuration of a phase circuit of the prior art phased array antenna.

Next, the functions of the bias regulating circuits 101*a*, 101*b*, 101*c*, and 101*d* are described as follows, referring to FIG. 2(*b*) and FIG. 2(*c*). Note that as the bias regulating circuits 101*a*, 101*b*, 101*c*, and 101*d* have the same functions, FIG. 2(*b*) shows a bias regulating circuit 101 without distinction from the other circuits. In FIG. 2(*b*), numeral 5 indicates a gate terminal corresponding to the gate terminals 5*a*, 5*b*, 5*c*, and 5*d*, numeral 7 indicates a bias terminal corresponding to the bias terminals 7*a*, 7*b*, 7*c*, and 7*d*, and R1 and R2 indicate the resistances of the first and second resistors 11 and 12, respectively. In this case, as for the resistances R1 and R2, R1=2.5kΩ and R2=3.5kΩ. In FIG. 2(*c*), V0 indicates the control voltage of the FET switch supplied from the external system (the control circuit 240 shown in FIG. 13) to the bias terminal 7 of the bias regulating circuit 101. Vg indicates the gate bias provided by the bias regulating circuit 101 to the gate terminal 5 of each of the FET switches.

In the bias regulating circuit 101 of the first embodiment, the control voltage V0 for the FET switch supplied to the bias terminal 7 from the system outside of the phase shifter is subjected to waveform transformation processing, and the waveform-transformed control voltage is applied, as gate bias Vg, to the gate 5 of the FET switch. The gate bias has two levels, the on-level is set at 5V for placing the FET switch in the on-state and the off-level is lower (around 3V) than the pinch-off voltage (around 4V) for placing the FET switch in the off-state. Therefore, the FET switch is not in the off-state when it has 0V applied as the gate bias, but the FET switch is in the off-state when it has 3V applied as the gate bias.

A GaAs MESFET is employed as an FET in the first embodiment because the elements constituting the phase shifter are a monolithic microwave IC (MMIC) operating at microwave frequencies.

In the phase shifter 100 of the first embodiment, when the control voltages V0 for the FET switches 50*a,* 50*b,* 50*c,* and 50*d* are applied to the bias terminals 7*a,* 7*b,* 7*c,* and 7*d,* the off-level of the control voltages V0 is converted to gate bias voltages Vg which are lower than the pinch-off voltage due to the bias regulating circuits 101*a,* 101*b,* 101*c,* and 101*d.* In other words, the off-level of the gate bias of the FET switch is lower (about 3V) than the pinch-off voltage in the first embodiment. (The off-level voltage is 0V in the prior art.) Therefore, the transit time of the FET switch from the off-state to the on-state is reduced and the switching speed is faster.

Figure 3:
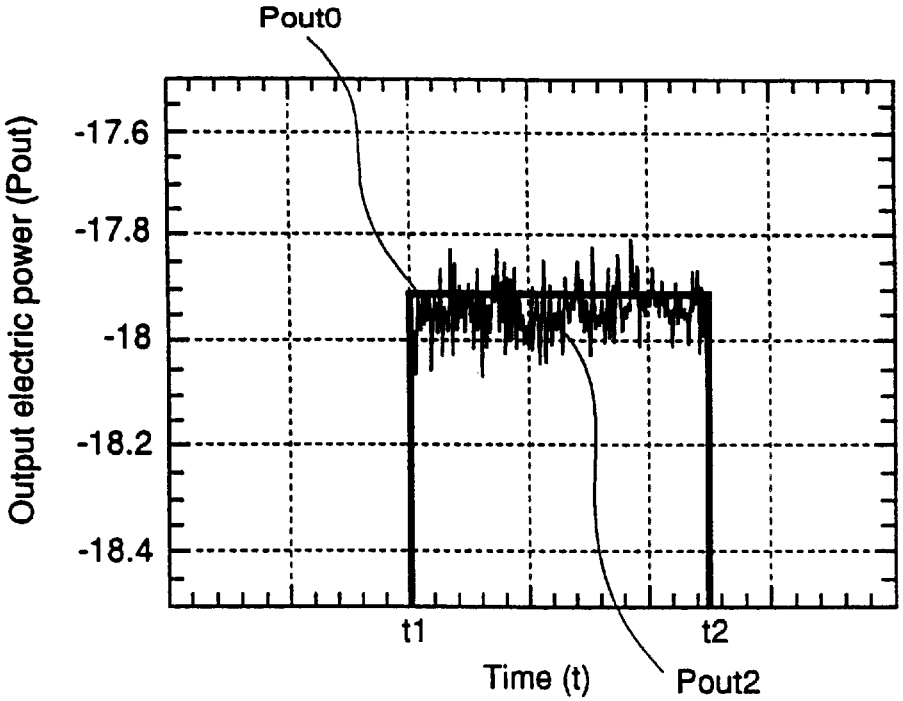
FIG. 3 is a graph showing an output waveform of the phase shifter of the first embodiment of the invention.
Figure 11:
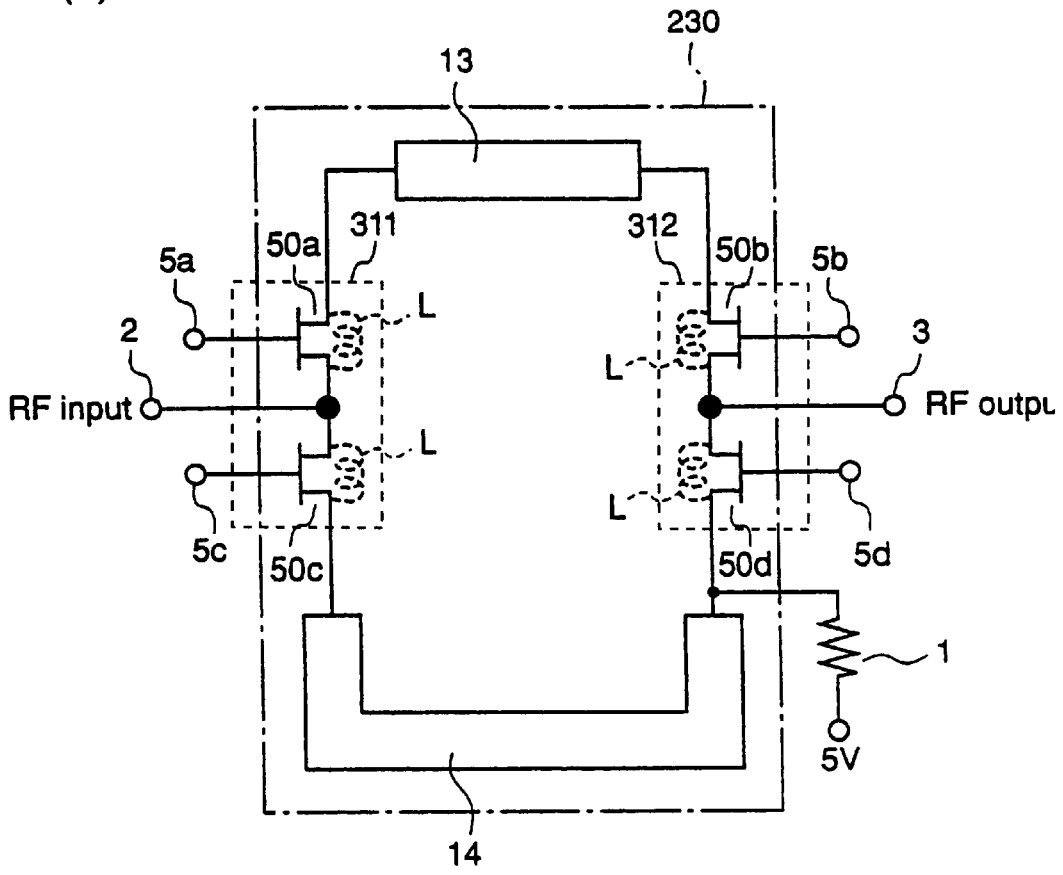
Prior Art Fig.11 (a)
FIG. 11(*a*) is a diagram showing a configuration of a prior art phase shifter.
Figure 11:
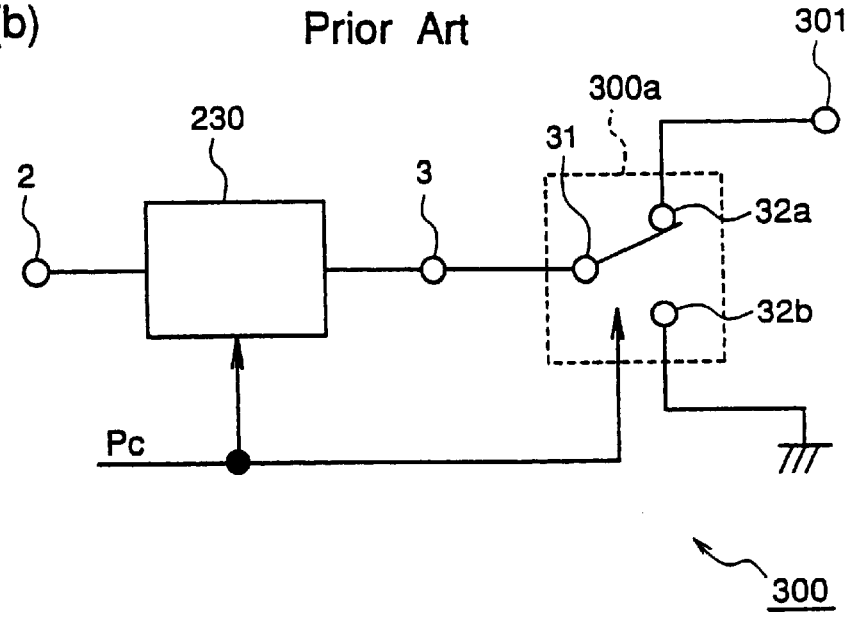
Fig.11 (b) Prior Art
Figure 12:
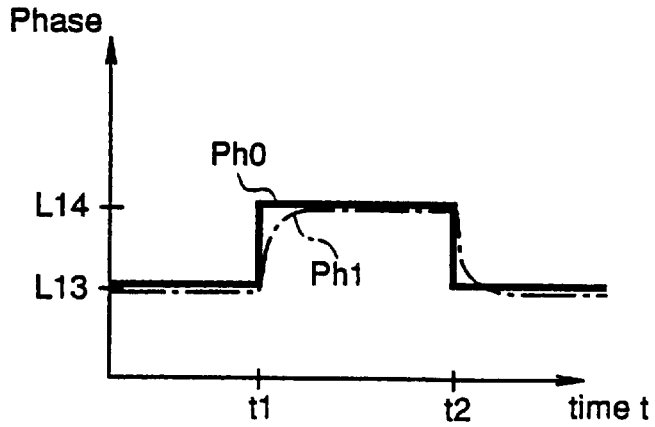
Prior Art Fig.12 (a)
FIG. 12(*a*) is a graph showing the phase change of the output of the prior art phase shifter of FIG. 11(*a*).
Figure 12:
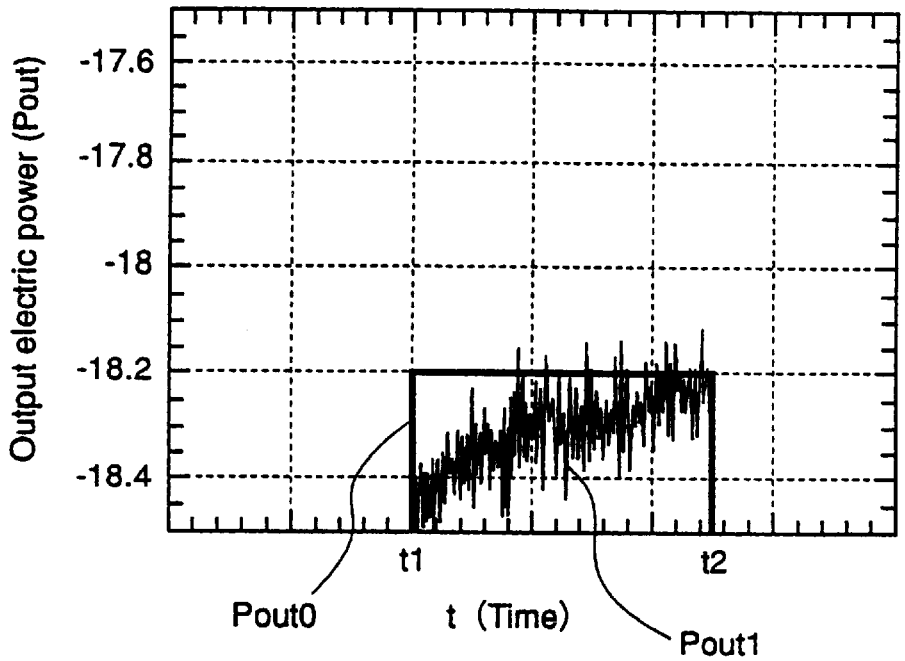
Fig.12 (b) Prior Art

FIG. 3 shows the output waveform of the phase shifter of the first embodiment during a period between the phase switching times t1 to t2, measured by a measurement circuit, such as the measurement circuit 300 shown in FIG. 11(*b*). The line Pout0 indicates an ideal output waveform. The line Pout2 indicates the actual output waveform of the phase shifter of the first embodiment. As will be apparent from FIG. 3, the delay in the rise of the phase shifter output, which occurs at the phase-switching time, is reduced as compared to the prior art phase shifter 230 (see FIG. 12(*b*)).

[Embodiment 2]

Figure 4:
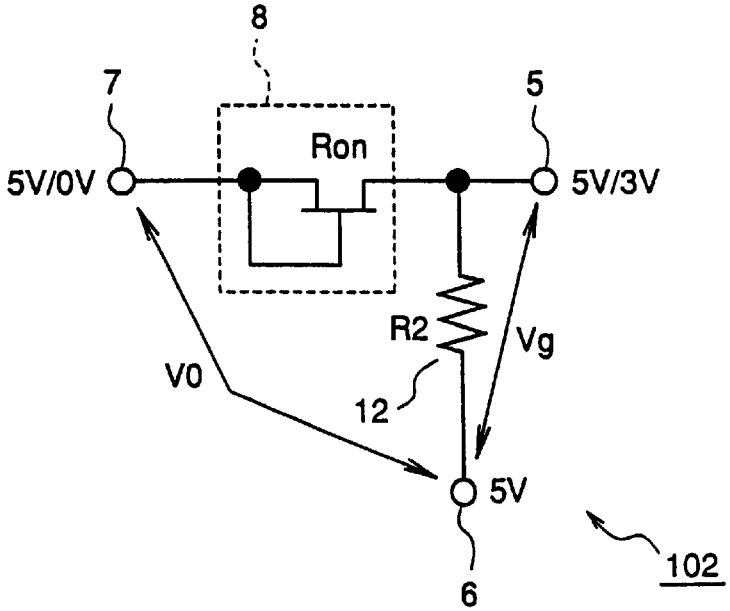
FIG. 4 is a diagram showing a bias regulating circuit of a phase shifter according to a second embodiment of the invention for explaining a microwave circuit as the phase shifter.

FIG. 4 shows the configuration of a bias regulating circuit of the phase shifter according to a second embodiment of the invention. A bias regulating circuit 102 includes a diode bias FET 8 instead of the first voltage dividing resistor 11. Except for that component, the configuration is the same as the first embodiment.

The bias FET 8 is the same FET as and is fabricated by the same process as the FET switches 50*a,* 50*b,* 50*c,* and 50*d* of the phase shifter 100. The bias FET 8 is a non-uniformity-compensating circuit which compensates for changes in the characteristics of the phase shifter caused by changes in the characteristics of an FET switch due to the variations in fabrication processing. The changes are compensated by the on-resistance Ron of the bias FET. In this case, the on-resistance Ron has, for example, a value of around 10Ω for a gate width of 400 $\mu$m.

In the second embodiment, the control voltage V0 for the FET switch is applied to the bias terminal 7, is then converted into the gate bias Vg, which is lower (3V) than the pinch-off voltage (4V), and is finally applied to the FET switch of the phase shifter. Therefore, the transit time of the FET switch from the off-state to the on-state is reduced and delay in the rise of the phase shifter output at the phase-switching time in the phase shifter is suppressed. Further, the non-uniformity of the characteristics of the phase shifter due to the fabrication process is suppressed.

The pinch-off voltage of the FET switch of the phase shifter varies due to the variations in fabrication processing. Since the bias FET 8 of the bias regulating circuit 102 is the same FET as the FET switch of the phase shifter, the change in the pinch-off voltage of the bias FET 8 is as large as the change in the pinch-off voltage of the FET switch.

As the pinch-off voltages of these FETs become deeper, that is, the voltage difference between the pinch-off voltage and the source voltage or between the pinch-off voltage and the drain voltage increases, the on-resistance Ron generally tends to become smaller. For example, if it is assumed that the pinch-off voltage becomes deeper than expected, the on-resistance Ron will become smaller than an expected value. Thereby, the voltage division ratio of the on-resistance Ron of the bias FET to the voltage of the resistor R2 of the voltage dividing resistor 12 is changed, and the voltage applied to the second voltage dividing resistor 12, i.e., the gate bias Vg, increases. The change of the characteristics of the phase shifter due to the pinch-off voltage of the FET switch becoming deeper is compensated because the pinch-off voltage of the bias FET 8 becomes deeper.

According to the second embodiment of the invention, the bias regulating circuit includes the compensation FET made in the same fabrication process as the FET switch, so that even when the pinch-off voltage of the FET switch of the phase shifter 4 changes due to variations in fabrication processing, the on-resistance of the compensation FET changes so that the bias voltage of the FET switch maintains a difference from the pinch-off voltage that is almost constant. Therefore, the desired situation that the bias Vg in the off-state is deeper by a constant value than the pinch-off voltage is maintained in spite of variations in fabrication processing, whereby the yield of the phase shifter is improved.

[Embodiment 3]

Figure 5:
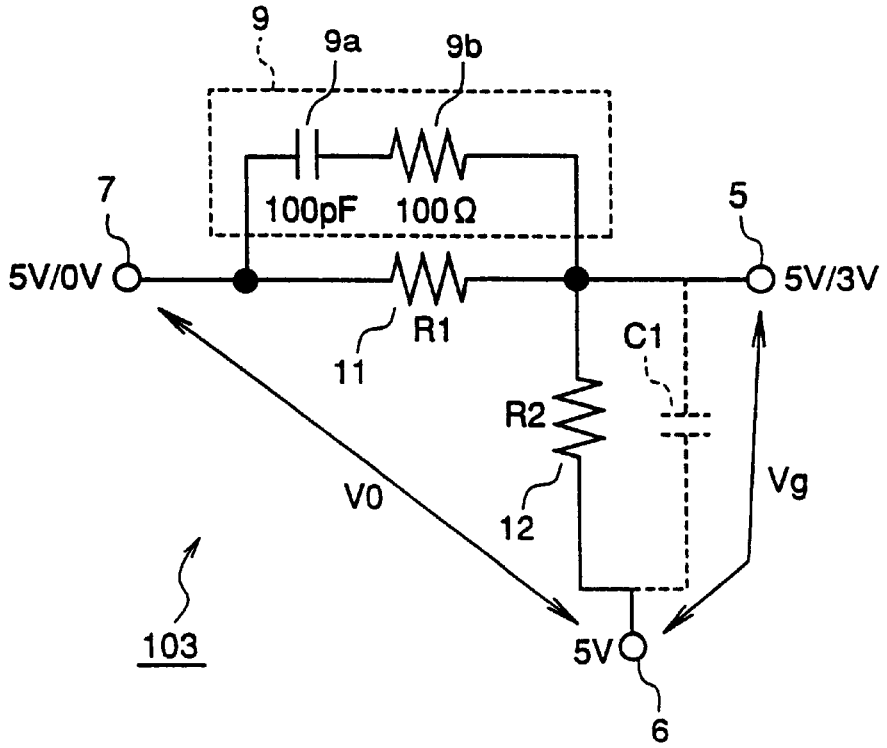
FIG. 5(*a*) is a diagram showing a bias regulating circuit of the phase shifter.
Figure 5:
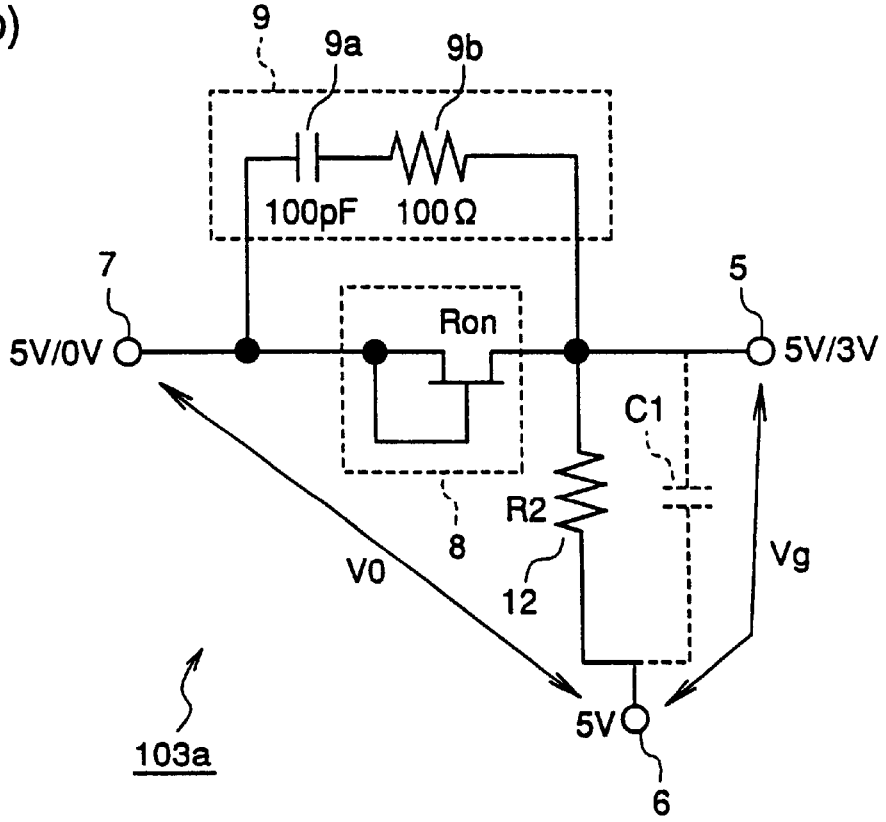

FIG. 5(*a*) and FIG. 5(*b*) are diagrams for explaining a phase shifter according to a third embodiment of the invention. FIG. 5(*a*) shows a bias regulating circuit 103, i.e., a component of the phase shifter.

The bias regulating circuit 103 includes a speedup circuit 9 connected in parallel to the first resistor 11 of the bias regulating circuit 101 of the first embodiment, depicted in FIG. 2(*b*). The speedup circuit 9 comprises a capacitor 9*a* and a resistor 9*b* which are connected to each other in series. The other components and how they are assembled are the same as those of the bias regulating circuit 101 of the first embodiment.

Figure 6:
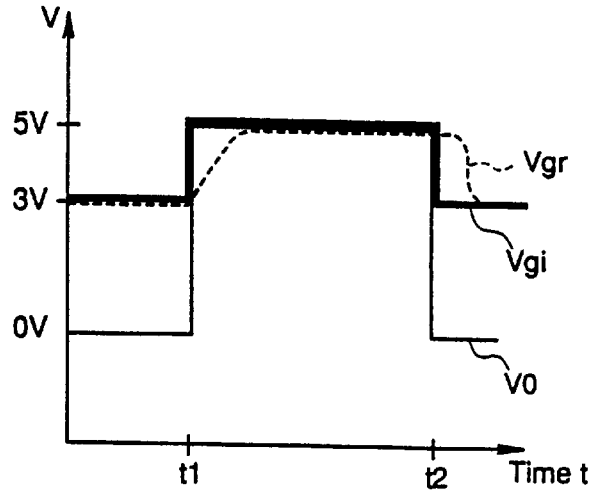
FIG. 6(*a*) is a graph showing a delay of the output change of the bias regulating circuit of the phase shifter of a third embodiment of the invention.
Figure 6:
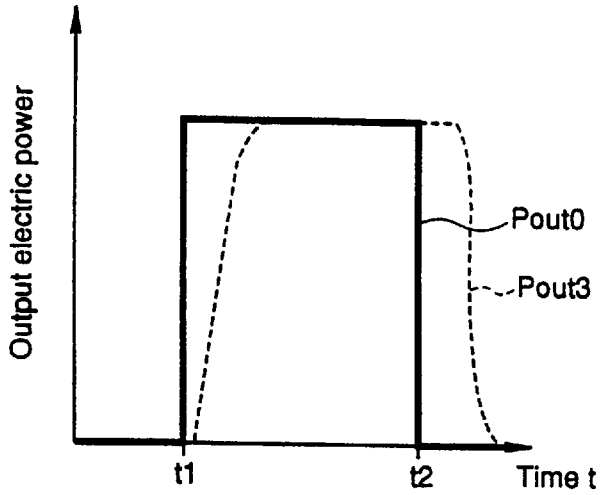
Figure 6:
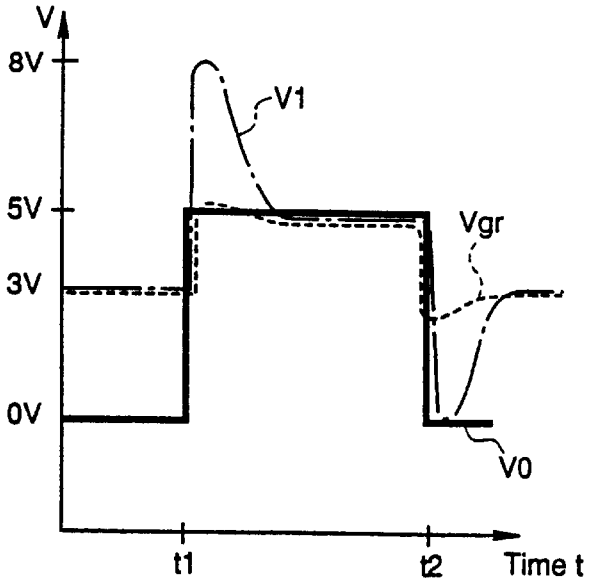

There generally exists a parasitic capacitance C1 between the gate terminal 5 of the FET switch and the power-source terminal 6. For this reason, as shown in FIG. 6(*a*), the actual change of the gate bias Vgr responding to a change of the control voltage V0 is delayed, compared to the ideal gate bias Vgi. As a result, the actual change of the output Pout3 of the phase shifter is delayed from the ideal change of the output Pout0 of the phase shifter of FIG. 6(*b*).

Since the bias regulating circuit 103 of the third embodiment includes, as shown in FIG. 5(*a*), the speedup circuit 9, when the control voltage V0 changes, if the parasitic capacitance C1 is ignored, the output V1 of the circuit 103 changes, as shown in FIG. 6(*c*), by the amount (5V) of the level change of the control voltage from the level before the level change. As the parasitic capacitance C1 actually exists at the gate terminal, the steep change of the output V1 cancels the effect of the parasitic capacitance. Consequently, the delay in the change of the gate bias due to the parasitic capacitance C1 is reduced and the change of the phase shifter output at the phase-switching times t1 and t2 becomes close to the ideal.

In the third embodiment, in the bias regulating circuit 101 of the first embodiment, the speedup circuit is connected to the voltage dividing element 11. The bias regulating circuit 102 of the second embodiment with the speedup circuit 9, as shown in FIG. 5(*b*), connected to the bias FET 8 is also within the scope of this invention.

[Embodiment 4]

Figure 7:
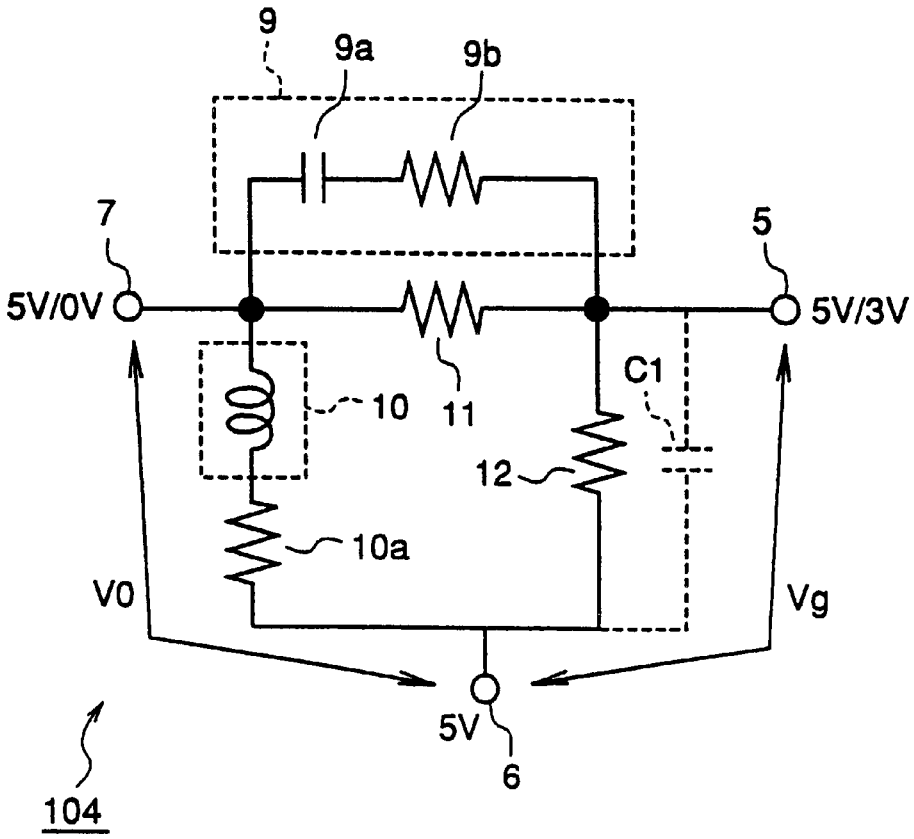
FIG. 7 is a diagram showing a bias regulating circuit of a phase shifter according to a fourth embodiment of the invention for explaining a microwave circuit as the phase shifter.

FIG. 7 is a diagram for explaining a phase shifter according to a fourth embodiment of the invention, illustrating a bias regulating circuit 104 as a component of the phase shifter.

The bias regulating circuit 104 is the same as that according to the third embodiment except that a ringing inductor 10 is connected between the power-source terminal 6 of the bias regulating circuit 103 of the third embodiment and the bias terminal 7 with a resistor 10*a* intervening.

The general characteristics of the resistance between the source and drain of a FET are, as shown in FIG. 8(*a*), such that the source-to-drain resistance Rsd changes at a delay time after the switching time t1 of the gate bias Vg. One of the causes of the delay is believed to be the effect of the negative electrical surface charge near the gate electrode of the FET.

For example, when the gate bias Vg changes from the off-level to the on-level as shown in FIG. 8(*a*), the contraction of the depletion layer is delayed compared to the change of the gate bias Vg as shown in FIG. 8(*b*) and FIG. 8(*c*). FIG. 8(*b*) shows the distribution of the surface charge 53 near the gate of the FET and the expanse of the depletion layer 52 when the gate bias is at the off-level. FIG. 8(*c*) shows the distribution of the surface charge 53 near the gate of the FET and the expanse of the depletion layer 52 immediately after the gate bias changes from the off-level to the on-level. As will be observed from FIG. 8(*b*) and FIG. 8(*c*), the depletion layer 52 does not perfectly disappear until the surface charge 53 is completely removed after the change of the gate bias Vg. For this reason, when the FET switch is switched by the gate bias Vg having almost the same waveform as the control voltage V0, the change of the source-to-drain resistance Rsd is delayed compared to the change of the control voltage V0. Therefore, the change of the actual phase shifter output, Pout4, is also delayed compared to the change of the ideal phase shifter output, Pout0, responding to the change of the control voltage V0, as shown in FIG. 9.

Figure 10:
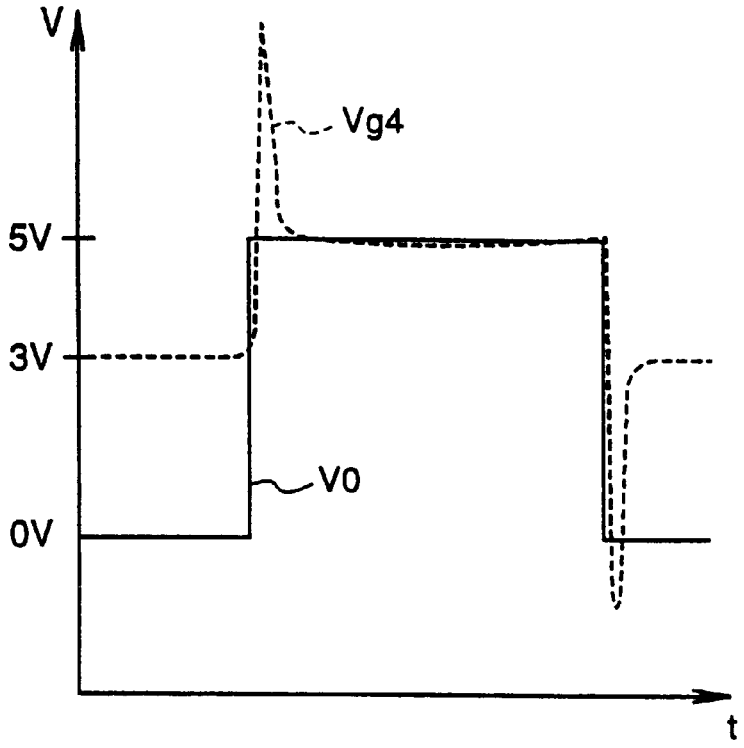
FIG. 10(*a*) is a graph showing an output waveform of the bias regulating circuit of the phase shifter of the fourth embodiment of the invention.
Figure 10:
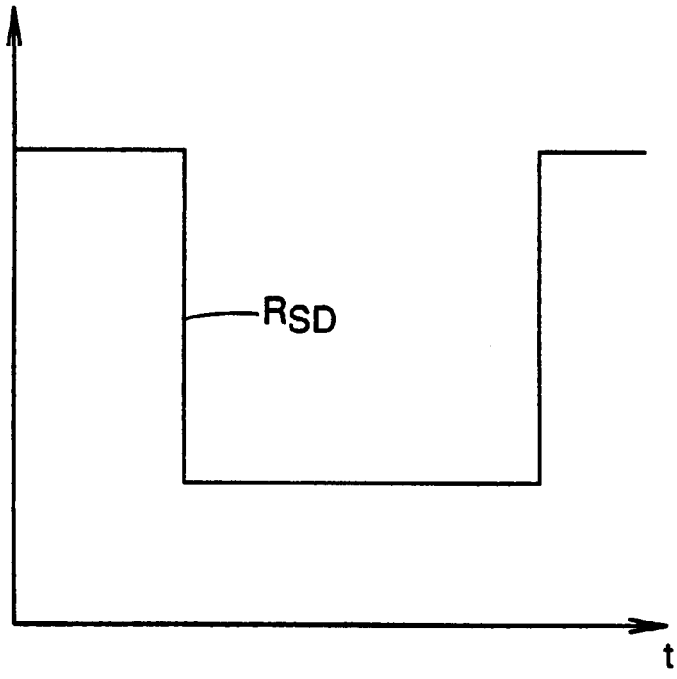

The bias regulating circuit 104 of the fourth embodiment is provided to solve this problem. In the bias regulating circuit 104 of the fourth embodiment shown in FIG. 7, the ringing inductor 10 is connected in parallel with the first and second voltage dividing resistors 11 and 12. Therefore, the control voltage V0 input to the bias terminal 7 is, due to the bias regulating circuit 104 shown in FIG. 10(*a*), converted to the gate bias Vg4 having a spike-like rising part (overshoot) of which the peak value is far beyond the maximum (5V) control voltage V0.

When the gate bias Vg4 having such an overshoot is applied to the FET, if the control voltage V0 is changed, the gate bias Vg4 changes far more steeply than the change of the control voltage, the surface charge near the gate is effectively removed, and the change of the source-to-drain resistance Rsd perfectly corresponds to the change of the control voltage V0. In other words, the delay, due to the surface charge, in the change of the source-to-drain resistance Rsd in responding to the change of the control voltage V0 is suppressed. As a result, the change of the phase shifter output is slower than the change of the control voltage.

Further, in the fourth embodiment, when the constants of the elements of the bias regulating circuit 104 make the waveform of the overshoot part suitable for the removal of the surface charge of the FET, the output waveform of the phase shifter can be the ideal output waveform which perfectly corresponds to the change of the control voltage V0.

What is claimed is:

1. A microwave circuit for changing the phase of a microwave signal comprising:

a first transmission route comprising a first transmission line having a first length and through which microwave signals may be transmitted, and first and second FET switch elements having respective first electrodes, second electrodes, and control electrodes, wherein the first electrode of the first FET switch element is connected to a first end of the first transmission line and the first electrode of the second FET switch element is connected to a second end of the first transmission line;

a second transmission route comprising a second transmission line having a second electrical length, different from the first electrical length, and through which microwave signals may be transmitted, and third and fourth FET switch elements having respective first electrodes, second electrodes, and control electrodes, wherein the first electrode of the third FET switch element is connected to a first end of the second transmission line and the first electrode of the fourth FET switch element is connected to a second end of the second transmission line;

an input terminal connected to the second electrodes of the first and third FET switch elements and an output terminal connected to the second electrodes of the second and fourth FET switch elements whereby the first and second transmission routes are connected in parallel;

first, second, third, and fourth signal transmission lines for receiving control signals for selecting the first transmission route or the second transmission route for transmitting an input microwave signal; and first, second, third, and fourth signal waveform transforming circuits respectively connecting the first, second, third, and fourth signal transmission lines to the control electrodes of the first, second, third, and fourth FET switch elements, wherein each of the first, second, third, and fourth waveform transforming circuits includes respective first and second dividing circuits, each first dividing circuit having a first terminal connected to the control electrode of the corresponding first, second, third, and fourth FET switch element, a second terminal connected to the corresponding first, second, third, and fourth signal transmission lines, and a respective FET element having gate, source, and drain electrodes, each gate electrode of an FET element being directly connected to one of the source and drain electrodes of said corresponding FET element, and each second dividing circuit including a first terminal connected to the control electrode of the corresponding first, second, third, and fourth FET switch element, and a second terminal connected to a constant voltage line.

2. A microwave circuit for changing the phase of a microwave signal, the circuit comprising:

a plurality of transmission lines having different electrical lengths and through which microwave signals may be transmitted, each transmission line having an input end and an output end;

a plurality of FET switch elements, each FET switch element having a respective source, gate, and drain and being switched on and off in response to a gate bias, respective FET switch elements being connected to the input ends of corresponding transmission lines and respective FET switch elements being connected to the output ends of corresponding transmission lines; and voltage waveform transforming means for generating a respective gate bias by processing a corresponding control voltage for each corresponding FET switch element and supplied by a power-source voltage, wherein the one of said transmission lines through which an input microwave signal propagates is selected by switching of said FET switch elements, for changing the phase of the microwave input signal, wherein said voltage waveform transforming means includes first and second voltage dividing resistance elements connected in series for generating the respective gate bias by voltage-dividing the corresponding control voltage using said first and second voltage dividing resistance elements, resistance values of said voltage dividing resistance elements being determined so that when a constant voltage equal to the power-source voltage is applied to the source and the drain of one of said FET switch elements, a difference between a pinch-off voltage of said FET switch element and an off-potential of the respective gate bias which places said FET switch element in an off-state, is a prescribed value.

3. The microwave circuit of claim 2 wherein said voltage waveform transforming means includes an auxiliary circuit comprising an auxiliary resistance element and a capacitance element connected in series, said auxiliary circuit being connected in parallel with said first voltage-dividing resistance element at a connecting point of said first and second voltage-dividing resistance elements and at a terminal to which the corresponding control voltage is applied.

4. The microwave circuit of claim 3 wherein said voltage waveform transforming means includes a second auxiliary circuit comprising an inductor element and a second auxiliary resistance element connected in series, said second auxiliary circuit being connected in parallel with said first and second voltage-dividing resistance elements connected in series, overshoot of the gate bias occurring when the respective gate bias output by said voltage waveform transforming means changes from an off-potential, which places said corresponding FET switch element in the off-state, to an on-potential, which places said corresponding FET switch element in an on-state.

5. The microwave circuit of claim 2 wherein said voltage waveform transforming means includes an auxiliary circuit comprising an inductor element and an auxiliary resistance element connected in series, said auxiliary circuit being connected in parallel with said first and second voltage-dividing resistance elements connected in series, overshoot of the respective gate bias occurring when the respective gate bias output by said voltage waveform transforming means changes from an off-potential, which places said corresponding FET switch element in the off-state, to an on-potential, which places said corresponding FET switch element in an on-state.

6. The microwave circuit of claim 5 wherein the overshoot of the respective gate bias removes electrical surface charge of said corresponding FET switch element.

7. A microwave circuit for changing the phase of a microwave signal, the circuit comprising:

a plurality of transmission lines having different electrical lengths and through which microwave signals may be transmitted, each transmission line having an input end and an output end;

a plurality of FET switch elements, each FET switch element having a respective source, gate, and drain and being switched on and off in response to a gate bias, respective FET switch elements being connected to the input ends of corresponding transmission lines and respective FET switch elements being connected to the output ends of corresponding transmission lines; and voltage waveform transforming means for generating a respective gate bias by processing a corresponding control voltage for each corresponding FET switch element and supplied by a power-source voltage, wherein the one of said transmission lines through which an input microwave signal propagates is selected by switching of said FET switch elements, for changing the phase of the microwave input signal, wherein said voltage waveform transforming means includes a diode bias FET element and a bias resistance element connected in series for generating the respective gate bias by voltage-dividing the corresponding control voltage with said bias resistance and bias diode FET elements, an off-potential of the respective gate bias placing said FET switch element in the off-state having a value so that a voltage difference between the off-potential and the pinch-off voltage of said FET switch element is larger than variations in the pinch-off voltages of said FET switch elements.

8. The microwave circuit of claim 7 wherein said voltage waveform transforming means includes an auxiliary circuit comprising an auxiliary resistance element and a capacitance element connected in series, said auxiliary circuit being connected in parallel with said diode bias FET at a connecting point of said diode bias FET and said bias resistance element and at a terminal to which the corresponding control voltage is applied.

9. A microwave circuit for changing the phase of a microwave signal comprising:

a first transmission route comprising a first transmission line having a first length and through which microwave signals may be transmitted, and first and second FET switch elements having respective first electrodes, second electrodes, and control electrodes, wherein the first electrode of the first FET switch element is connected to a first end of the first transmission line and the first electrode of the second FET switch element is connected to a second end of the first transmission line;

a second transmission route comprising a second transmission line having a second electrical length, different from the first electrical length, and through which microwave signals may be transmitted, and third and fourth FET switch elements having respective first electrodes, second electrodes, and control electrodes, wherein the first electrode of the third FET switch element is connected to a first end of the second transmission line and the first electrode of the fourth FET switch element is connected to a second end of the second transmission line;

an input terminal connected to the second electrodes of the first and third FET switch elements and an output terminal connected to the second electrodes of the second and fourth FET switch elements whereby the first and second transmission routes are connected in parallel; and first, second, third, and fourth signal transmission lines for receiving control signals for selecting the first transmission route or the second transmission route for transmitting an input microwave signal, and first, second, third, and fourth signal waveform transforming circuits including respective first and second dividing circuits and a first auxiliary circuit, each first dividing circuit having a first terminal connected to the control electrode of the corresponding first, second, third, and fourth FET switch element, a second terminal connected to the corresponding first, second, third, and fourth signal transmission line, and a respective first resistance element, each second dividing circuit including a first terminal connected to the control electrode of the corresponding first, second, third, and fourth FET switch element, and a second terminal connected to a constant voltage line, and each first auxiliary circuit comprising a first series circuit of a resistance element and a capacitance element, each first auxiliary circuit being connected in parallel with the corresponding first resistance element.

10. The microwave circuit of claim 9 wherein each of the first, second, third, and fourth waveform transforming circuits includes a second auxiliary circuit comprising a second series circuit of a second resistance element and an inductive element, each second auxiliary circuit being connected in parallel with the corresponding first and second dividing circuits.

* * * * *